US009022529B2

(12) United States Patent
Takaai et al.

(10) Patent No.: US 9,022,529 B2
(45) Date of Patent: May 5, 2015

(54) LIQUID EJECTING HEAD AND LIQUID EJECTING APPARATUS

(71) Applicant: Seiko Epson Corporation, Tokyo (JP)

(72) Inventors: Hitoshi Takaai, Azumino (JP); Yuma Fukuzawa, Matsumoto (JP); Yoichi Naganuma, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/300,009

(22) Filed: Jun. 9, 2014

(65) Prior Publication Data

US 2014/0362142 A1 Dec. 11, 2014

(30) Foreign Application Priority Data

Jun. 10, 2013 (JP) ..... 2013-121579
Jul. 22, 2013 (JP) ..... 2013-151380
Jan. 29, 2014 (JP) ..... 2014-014085

(51) Int. Cl.
*B41J 2/05* (2006.01)
*B41J 2/14* (2006.01)

(52) U.S. Cl.
CPC .... *B41J 2/14201* (2013.01); *B41J 2002/14306* (2013.01)

(58) Field of Classification Search
CPC ..... B41J 2/1404; B41J 2/14233; B41J 2/161
USPC ..... 347/65, 68, 70, 71
See application file for complete search history.

(56) References Cited

U.S. PATENT DOCUMENTS

2005/0036011 A1* 2/2005 Watanabe ..... 347/71

FOREIGN PATENT DOCUMENTS

JP 2006-218716 8/2006

* cited by examiner

*Primary Examiner* — Henok Legesse
(74) *Attorney, Agent, or Firm* — Workman Nydegger

(57) ABSTRACT

A liquid ejecting head includes a pressure chamber substrate formed of silicon where a pressure chamber is formed, and a communication plate penetrated by communication holes in a plate thickness direction, in which the pressure chamber partitioned by partition walls formed of crystal orientation planes being formed in the recording head through etching. Acute angle portions are formed, by the partition walls intersecting with each other at an acute angle, in both end portions of the pressure chamber in a first direction, and a first step is disposed in the middle of each of the acute angle portions in an etching direction. Parts of the communication holes are arranged at positions superimposed on the acute angle portions in a bonding surface and remaining parts of the communication holes are arranged on outer sides in the first direction with respect to the acute angle portions such that a second step is formed in a communication portion between the pressure chamber and the communication holes.

8 Claims, 7 Drawing Sheets

PRIOR ART

LIQUID EJECTING HEAD AND LIQUID EJECTING APPARATUS

BACKGROUND

1. Technical Field

The present invention relates to a liquid ejecting head such as an ink jet type recording head, and a liquid ejecting apparatus including a liquid ejecting head.

2. Related Art

A liquid ejecting apparatus is an apparatus that includes a liquid ejecting head which is capable of ejecting droplets of a liquid from a nozzle and ejects various types of liquids from the liquid ejecting head. Representative examples of the liquid ejecting apparatus include an image recording apparatus, such as an ink jet type recording apparatus (printer), which includes an ink jet type recording head (hereinafter, referred to as a recording head) and performs recording by ejecting ink droplets of a liquid ink from a nozzle of the recording head. In addition, such liquid ejecting apparatuses are used in ejecting various types of liquids such as a color material used in a color filter such as a liquid crystal display, an organic material used in an organic electro luminescence (EL) display, and an electrode material used in forming an electrode. The liquid ink is ejected from the recording head for the image recording apparatus, and a solution of each of red (R), green (G), and blue (B) color materials is ejected from a color material ejecting head for a display manufacturing apparatus. In addition, a liquid electrode material is ejected from a liquid material ejecting head for an electrode forming apparatus, and a bio-organic material solution is ejected from a bio-organic material ejecting head for a chip manufacturing apparatus.

In an example of the recording heads described above, a communication plate 95 is disposed between a pressure chamber substrate 92 where a pressure chamber 91 is formed and a nozzle plate 94 where a nozzle 93 is open as illustrated in FIG. 11. A communication hole 96, which allows communication of the pressure chamber 91 with the nozzle 93, is disposed in the communication plate 95. The pressure chamber substrate 92 and the communication plate 95, and the communication plate 95 and the nozzle plate 94 are bonded via an adhesive. The liquid adhesive is used to fill a gap between the substrates. In addition, an upper side (side opposite to the communication plate 95) of the pressure chamber 91 is sealed by an elastic film 97, and an active portion 99, which is displaced in response to a change of a piezoelectric element 98 (a type of pressure generator) bonded to the upper side, is formed. The recording head having this configuration generates a pressure change in the ink in the pressure chamber 91 as the active portion 99 is displaced when the piezoelectric element 98 is driven. By using the pressure change, the ink in the pressure chamber 91 is ejected from the nozzle 93 via the communication hole 96.

The pressure chamber substrate 92 described above is produced through wet etching of, for example, a silicon single crystal substrate whose surface is a (110) plane. Accordingly, the pressure chamber 91 is formed into a parallelogrammic shape when viewed from a bonding surface side between the pressure chamber substrate 92 and the communication plate 95. In the pressure chamber 91 described above, two acute angle portions are formed at corners on diagonal lines of the parallelogram. In addition, the communication hole 96 can also be produced through wet etching of the silicon single crystal substrate, and is formed into a parallelogrammic shape when viewed from a bonding surface side between the communication plate 95 and the nozzle plate 94.

A phenomenon of the adhesive moving to the upper side (side opposite to the nozzle plate 94) due to a capillary force when the substrates are bonded via the adhesive was confirmed in the recording head described above (refer to an arrow in FIG. 11). Specifically, the adhesive moved along wall surfaces of the pressure chamber 91 and the communication hole 96. Particularly, the movement of the adhesive was likely to occur in the acute angle portions of the pressure chamber 91 and the communication hole 96. When the adhesive moved along the acute angle portion and cured in a state where the adhesive reached the active portion 99 of the pressure chamber 91, the displacement of the active portion 99 was inhibited and the ejection characteristics of the ink ejected from the nozzle 93 (the amount and flying speed of the ink droplets) may be subject to variations. A step disposed on a side wall of the pressure chamber substrate 92 partitioning the pressure chamber 91 was proposed so as to suppress this inconvenience (for example, JP-A-2006-218716). In this manner, it was possible to prevent the adhesive that moved along the acute angle portion of the pressure chamber 91 from reaching the active portion 99.

However, the step that is disposed on the side wall of the pressure chamber as described above was not sufficient. For example, during the bonding of the pressure chamber substrate with the communication plate via the adhesive, the adhesive may move to the active portion, over the step on the side wall of the pressure chamber, depending on the viscosity of the adhesive in the liquid state, the contact angle of the adhesive in the liquid state with respect to the pressure chamber substrate, the variations of the application amount of the adhesive applied between the substrates, and the like. Accordingly, the variations of the ejection characteristics of the ink ejected from the nozzle could not be suppressed.

SUMMARY

An advantage of some aspects of the invention is to provide a liquid ejecting head and a liquid ejecting apparatus that are capable of preventing an adhesive from curing in an active portion of a pressure chamber and are capable of suppressing variations of liquid ejection characteristics.

According to a first aspect of the invention, there is provided a liquid ejecting head including a pressure chamber substrate where a pressure chamber that communicates with a nozzle which ejects a liquid is formed, and a communication plate that is bonded to one surface of the pressure chamber substrate and is penetrated in a plate thickness direction by a communication hole which communicates with an end portion of the pressure chamber in a first direction, in which at least two steps are formed, shifted in a plane direction parallel to a bonding surface between the pressure chamber substrate and the communication plate, in an inner wall surface of a flow path reaching the communication hole from the pressure chamber.

According to the aspect of the invention, the two or more steps are formed on the inner wall surface of the flow path reaching the communication hole from the pressure chamber, and thus the movement of the adhesive to the side opposite to the communication plate is inhibited when the pressure chamber substrate and the communication plate are bonded via the liquid adhesive. In this manner, it is possible to suppress the adhesive from reaching the active portion of the pressure chamber and curing, and thus the inhibition of the displacement of the active portion by a cured adhesive can be suppressed. As a result, the variations of the ejection characteristics of the ink ejected from the nozzle can be suppressed.

According to a second aspect of the invention, there is provided a liquid ejecting head including a pressure chamber substrate where a pressure chamber that communicates with a nozzle which ejects a liquid is formed, and a communication plate that is bonded to one surface of the pressure chamber substrate and is penetrated in a plate thickness direction by a communication hole which communicates with an end portion of the pressure chamber in a first direction, in which acute angle portions are formed, by partition walls intersecting with each other at an acute angle, in both end portions of the pressure chamber in a first direction, a first step is disposed in a middle of each of the acute angle portions in the plate thickness direction, and a second step is formed in a communication portion between the pressure chamber and the communication hole by arranging a part of the communication hole at a position superimposed on the acute angle portion in the bonding surface and arranging a remaining part of the communication hole on an outer side in the first direction with respect to the acute angle portion.

According to the aspect of the invention, the first step is disposed in the pressure chamber and the second step is also formed in the communication portion between the pressure chamber and the communication hole, and thus the movement of the adhesive to the other side (side opposite to the communication plate) along the acute angle portion is inhibited by these steps when the pressure chamber substrate and the communication plate are bonded via the liquid adhesive. In this manner, it is possible to prevent the adhesive from reaching the active portion, which is formed on the other side of the pressure chamber, and curing, and thus the inhibition of the displacement of the active portion by a cured adhesive can be suppressed. As a result, the variations of the ejection characteristics of the ink that is ejected from the nozzle can be suppressed. In addition, the penetration of the pressure chamber by the adhesive is suppressed by the second step even when the adhesive moves toward the pressure chamber side during the bonding of the communication plate with the nozzle plate which is bonded to the side of the communication plate opposite to the pressure chamber substrate via the liquid adhesive. As a result, the variations of the ejection characteristics of the ink that is ejected from the nozzle can be further suppressed. Further, since the pressure chamber substrate is formed of silicon, the first step can be produced through one session of etching process.

In the above-described configuration, it is preferable that the communication plate have a first communication hole that communicates with an end portion on one side of the pressure chamber in the first direction, and a second communication hole that communicates with an end portion on the other side of the pressure chamber in the first direction, and the second step be formed in each of the communication portions between both of the acute angle portions of the pressure chamber and the first communication hole and the second communication hole.

According to this configuration, it is possible to prevent the adhesive from reaching the active portions along both of the acute angle portions even in a case where the first communication hole and the second communication hole communicate with both of the end portions of the pressure chamber.

In the above-described configuration, it is preferable that the first step be disposed in an inclined surface that is formed in a state of being inclined with respect to the bonding surface between the partition walls partitioning the acute angle portion and extend from a vertex of the acute angle portion on the bonding surface to a surface on a side opposite to the bonding surface on the pressure chamber substrate.

According to this configuration, the inclined surface is disposed between the partition walls partitioning the acute angle portion, and thus a capillary force is unlikely to be exerted at the part and the movement of the adhesive is suppressed. In addition, since the first step is disposed in the inclined surface, the movement of the adhesive ahead of the first step is further suppressed.

According to a third aspect of the invention, there is provided a liquid ejecting apparatus including the liquid ejecting head having the configuration according to any one of the above aspects.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments of the invention will be described with reference to the accompanying drawings. Various limitations are applied in the following description of the embodiments as preferred specific examples of the invention, but the scope of the invention is not limited to these aspects unless the invention is particularly described to be so in the following description. In the following description, an ink jet type printer (hereinafter, referred to as a printer) that is equipped with an ink jet type recording head (hereinafter, referred to as a recording head) will be used as an example of a liquid ejecting apparatus according to the invention.

Figure 1:
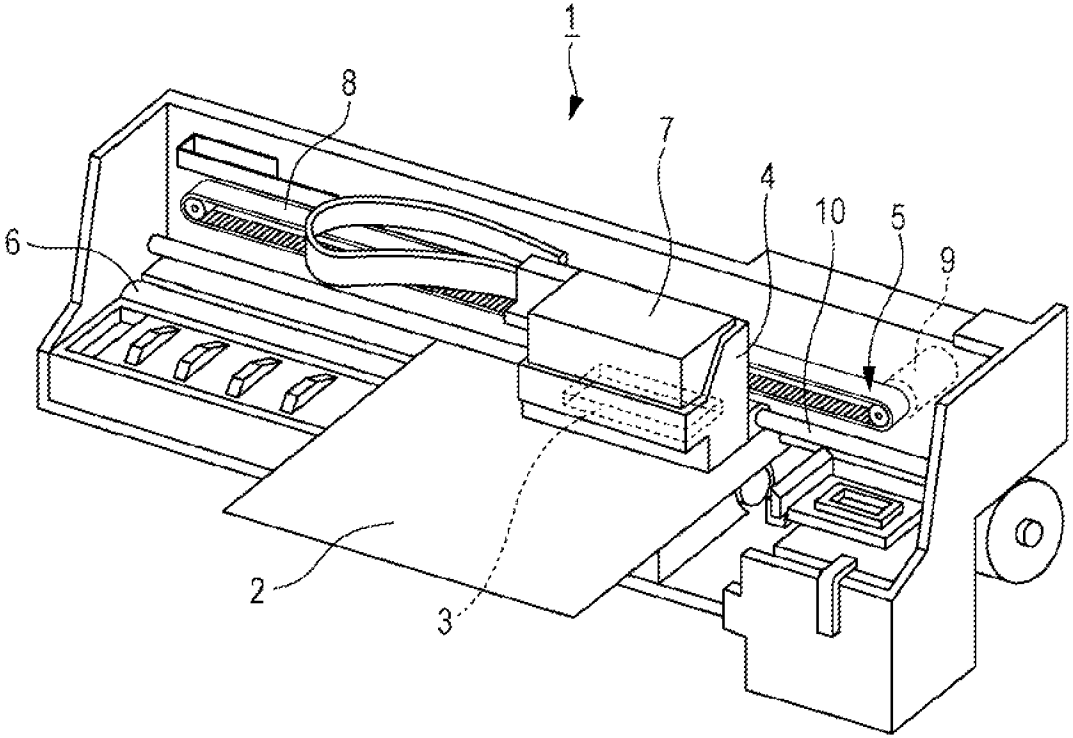
FIG. 1 is a perspective view illustrating a configuration of a printer.

A configuration of a printer 1 will be described with reference to FIG. 1. The printer 1 is an apparatus that performs recording of an image or the like, by ejecting a liquid ink, on a surface of a recording medium 2 (a type of landing target) such as recording paper. The printer 1 includes a recording head 3 that ejects the ink, a carriage 4 on which the recording head 3 is mounted, a carriage moving mechanism 5 that moves the carriage 4 in a main scanning direction, a platen roller 6 that transports the recording medium 2 in a sub-scanning direction, and the like. The ink that is described above is stored in an ink cartridge 7 as a liquid supply source. The ink cartridge 7 is mounted in a removable manner on the recording head 3. A configuration in which the ink cartridge 7 is arranged on a main body side of the printer 1 and the ink is supplied from the ink cartridge 7 to the recording head 3 through an ink supply tube also can be adopted.

The carriage moving mechanism 5 has a timing belt 8. The timing belt 8 is driven by a pulse motor 9 such as a DC motor. As such, when the pulse motor 9 is put into operation, the carriage 4 is guided by a guide rod 10 that is disposed across the printer 1 and reciprocates in the main scanning direction (width direction of the recording medium 2).

Figure 2:
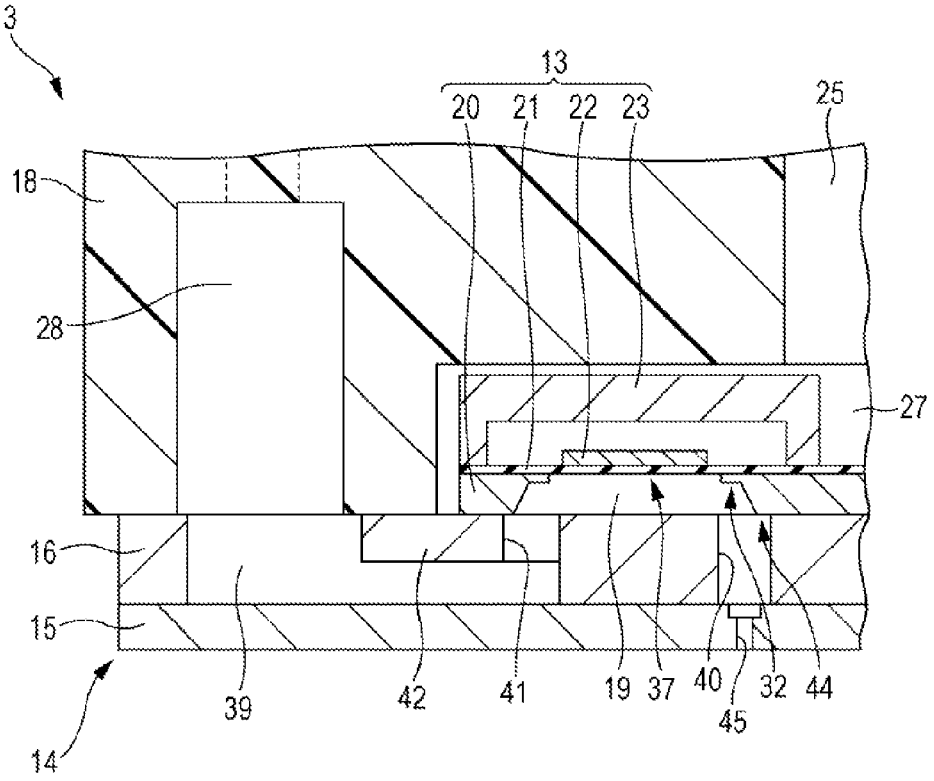
FIG. 2 is a cross-sectional view of a recording head.
Figure 3A:
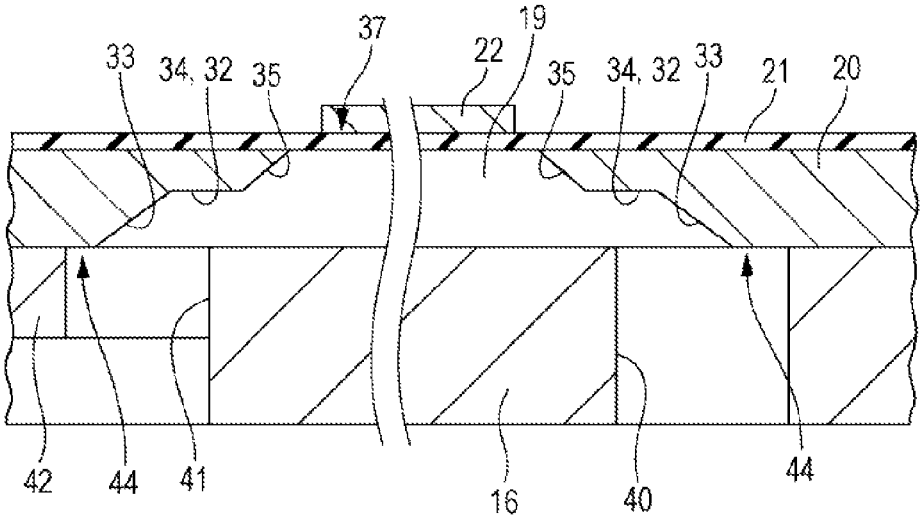
FIG. 3A is an enlarged cross-sectional view of a main part of the recording head.
Figure 3B:
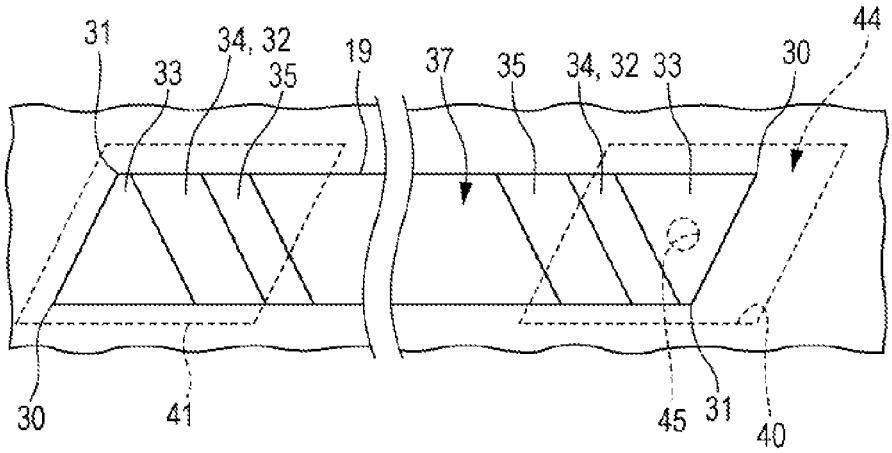
FIG. 3B is an enlarged bottom view of a main part of a pressure chamber substrate.

Next, the recording head 3 will be described. FIG. 2 is a cross-sectional view of the recording head 3. FIG. 3A is an enlarged cross-sectional view of a main part of the recording head 3, and FIG. 3B is an enlarged bottom view of a main part of a pressure chamber substrate 20. In FIG. 2, a configuration corresponding to the other nozzle column is symmetrical in a crosswise direction with what is illustrated in the drawing and thus description thereof will be omitted. In addition, a direction in which each member is stacked is assumed as a perpendicular direction for convenience of description. Further, an individual communication hole 41, a nozzle communication hole 40, and a nozzle 45 superimposed in the perpendicular direction on a pressure chamber 19 are represented by dashed lines in FIG. 3B.

As illustrated in FIG. 2, the recording head 3 according to the present embodiment has a pressure generating unit 13 and a flow path unit 14, and is configured such that these members are mounted in a stacked state on a case 18. The flow path unit 14 has a nozzle plate 15 (a type of nozzle forming member) and a communication plate 16. In addition, the pressure generating unit 13 is formed as a unit in which the pressure chamber substrate 20 where the pressure chamber 19 is formed, an elastic film 21, a piezoelectric element 22 (a type of pressure generator according to the invention), and a protective substrate 23 are stacked.

The case 18 is a box-shaped member formed of a synthetic resin, where the communication plate 16 to which the pressure generating unit 13 is bonded is fixed to a bottom surface side. A penetrating hollow portion 25 that has a rectangular opening which is elongated along an array direction (nozzle column direction) of the nozzles 45 is formed, in a state where the penetrating hollow portion 25 penetrates the case 18 in a height direction, at a central part of the case 18 in a plan view. One end portion of a head cable (not illustrated) is accommodated in the penetrating hollow portion 25. In addition, an accommodating hollow portion 27 that is recessed into a rectangular parallelepiped shape from a lower surface of the case 18 to the middle of the height direction of the case 18 is formed on the lower surface side of the case 18. The pressure generating unit 13 is accommodated in the accommodating hollow portion 27. Furthermore, an ink introduction path 28 is formed in the case 18. A lower end of the ink introduction path 28 communicates with a common liquid chamber 39 of the communication plate 16 (described later), and the ink introduction path 28 is a flow path through which the ink from the ink cartridge 7 is introduced to the common liquid chamber 39. As described later, two nozzle columns are formed on the nozzle plate 15 according to the present embodiment, and the two ink introduction paths 28 are disposed to correspond thereto.

The pressure chamber substrate 20, which is a member constituting the pressure generating unit 13, is manufactured by a silicon single crystal substrate. A plurality of the pressure chambers 19 are formed in the pressure chamber substrate 20 to correspond to the respective nozzles 45 of the nozzle plate 15. In the present embodiment, two columns of the pressure chambers 19 are formed to correspond to the two nozzle columns. The pressure chamber 19 is a hollow portion that is elongated in a direction (first direction) that is orthogonal to the nozzle column direction. When the pressure chamber substrate 20 (pressure generating unit 13) is bonded to the communication plate 16 (described later) in a positioned state, one end portion of the pressure chamber 19 in the first direction communicates with the nozzle communication hole 40 of the communication plate 16 (described later). In addition, the other end portion of the pressure chamber 19 in the first direction communicates with the individual communication hole 41 of the communication plate 16.

The pressure chamber 19 of the invention is produced, through the plate thickness, by etching the pressure chamber substrate 20 that is formed of the silicon single crystal substrate whose surface is a (110) plane from a bonding surface side between the communication plate 16 and the pressure chamber substrate 20. Partition walls that partition the pressure chamber 19 are formed by crystal orientation planes. As illustrated in FIG. 3B, the pressure chamber 19 of the present embodiment is formed into a parallelogrammic shape in a plan view (when viewed from the bonding surface side between the pressure chamber substrate 20 and the communication plate 16). In other words, in the plan view, an acute angle portion 30 is formed by the partition walls intersecting with each other at an acute angle and an obtuse angle portion 31 is formed by the partition walls intersecting with each other at an obtuse angle at both end portions of the pressure chamber 19 in the first direction. A first step 32 that has a plane which is parallel to the surface (bonding surface between the pressure chamber substrate 20 and the communication plate 16) of the pressure chamber substrate 20, that is, the (110) plane, is disposed in the middle of each of the acute angle portions 30 in the etching direction (thickness direction of the pressure chamber substrate 20).

As illustrated in FIG. 3A or 3B, the first step 32 is disposed between the partition walls that partition the acute angle portion 30, and is formed by disposing the (110) plane in the middle of a (111) plane (corresponding to an inclined surface according to the invention) which is inclined by approximately 30 degrees with respect to the surface of the pressure chamber substrate 20. Specifically, a communication plate side (111) plane 33 that extends from a vertex of the acute angle portion 30 on the lower surface (bonding surface side to the communication plate 16) to the middle of an upper surface side (elastic film 21 side), an intermediate (110) plane 34 that continues to an upper end side of the communication plate side (111) plane 33, and an elastic film side (111) plane 35 that continues to the side opposite to the communication plate side (111) plane 33 of the intermediate (110) plane 34 and extends to the upper surface are formed on each of both sides of the pressure chamber 19 in the first direction. The first step 32 is formed by disposing the intermediate (110) plane 34 between the communication plate side (111) plane 33 and the elastic film side (111) plane 35 in this manner. An area between the elastic film side (111) plane 35 on one side and the elastic film side (111) plane 35 on the other side of the pressure chamber 19 in the first direction is in a state of being penetrated by the pressure chamber substrate 20. In the present embodiment, the first steps 32 that are formed in both of the end portions of the pressure chamber 19 in the first direction are formed in point symmetry with respect to the center of the pressure chamber 19 in a plan view. In other words, the pressure chamber 19 is formed in point symmetry with respect to the center thereof in a plan view. Etching of the pressure chamber substrate 20 will be described in detail later.

The elastic film 21 is formed, in a state where an upper end side opening of the pressure chamber 19 is sealed, on an upper surface (surface on the side opposite to the bonding surface to the communication plate 16) of the pressure chamber substrate 20. The elastic film 21 is formed of silicon dioxide with a thickness of, for example, approximately 1 μm. In addition, the piezoelectric element 22 is formed on the elastic film 21 via an insulating film (not illustrated). The piezoelectric element 22 of the present embodiment is the piezoelectric element 22 of a so-called flexural mode, and is configured through patterning for each of the pressure chambers 19 after a lower electrode, a piezoelectric layer, and an upper electrode film (all of which are not illustrated) are sequentially stacked. In addition, the piezoelectric element 22 of the present embodiment is patterned to be slightly smaller than a penetration part of the pressure chamber substrate 20. The elastic film 21 or the like that is formed in an area superimposed on the penetration part of the pressure chamber substrate 20 functions as an active portion 37 that is displaced (changed) when the piezoelectric element 22 is driven. An electrode wiring portion (not illustrated) extends on the insulating film from an individual electrode (upper electrode film) of each of the piezoelectric elements 22, and a terminal on one end side of the head cable is connected to parts of these electrode wiring portions corresponding to electrode terminals. Each of the piezoelectric elements 22 is subjected to a flexural deformation when a control signal from a control unit (not illustrated) is applied between the upper electrode film and a lower electrode film through the head cable. In addition, the protective substrate 23 is arranged on the upper surface of the pressure chamber substrate 20 where the piezoelectric element 22 is formed as illustrated in FIG. 2. The protective substrate 23 is a hollow box-shaped member with an open lower surface side, and is manufactured by a silicon single crystal substrate, a metal, a synthetic resin, or the like. The piezoelectric element 22 is accommodated in the protective substrate 23.

As illustrated in FIG. 2, the communication plate 16, which is a member constituting the flow path unit 14, is a substrate that is pinched between the pressure chamber substrate 20 and the nozzle plate 15. In other words, the pressure chamber substrate 20 is bonded to the upper surface side of the communication plate 16, and the nozzle plate 15 is bonded to a lower surface side of the communication plate 16. A liquid adhesive is used to bond these substrates with each other. The communication plate 16 of the present embodiment is produced by etching the silicon single crystal substrate whose surface is formed of the (110) plane. The common liquid chamber 39, the nozzle communication hole 40 (corresponding to a first communication hole of the invention), and the individual communication hole 41 (corresponding to a second communication hole of the invention) are formed in the communication plate 16.

The nozzle communication hole 40 and the individual communication hole 41 are flow paths that penetrate the communication plate 16 in a plate thickness direction, and communicate with both of the end portions of the pressure chamber 19 in the first direction. Specifically, an upper end of the nozzle communication hole 40 communicates with an end portion on one side (right side in FIG. 2 or FIGS. 3A and 3B) of the pressure chamber 19 in the first direction. A lower end of the nozzle communication hole 40 communicates with the nozzle 45. In addition, an upper end of the individual communication hole 41 communicates with an end portion on the other side (left side in FIG. 2 or FIGS. 3A and 3B) of the pressure chamber 19 in the first direction. A lower end of the individual communication hole 41 communicates with the common liquid chamber 39. The common liquid chamber 39 is a hollow portion that is formed in a series in the nozzle column direction, and is formed in two rows to correspond to the two nozzle columns. A part of the common liquid chamber 39 on the nozzle 45 side (pressure chamber 19 side) is formed in a state where the communication plate 16 is recessed from a surface on the nozzle plate 15 side to the middle of the communication plate 16 in the thickness direction and a thin portion 42 is left on the pressure chamber substrate 20 side. The individual communication hole 41 penetrating in the plate thickness direction is open to the thin portion 42 of the communication plate 16.

In the present embodiment, the communication plate 16 that is formed of the silicon single crystal substrate whose surface is the (110) plane is formed by etching, and thus partition walls that partition the nozzle communication hole 40 and the individual communication hole 41 are formed by crystal orientation planes formed of the (111) plane. In other words, the nozzle communication hole 40 and the individual communication hole 41 are formed into parallelogrammic shapes in a plan view as illustrated in FIG. 3B. In addition, the nozzle communication hole 40 and the individual communication hole 41 of the present embodiment are formed to be wider (longer) in width (length in the nozzle column direction) than the pressure chamber 19, and both end portions in the width direction are arranged on further outer sides than the pressure chamber 19 in a plan view.

Furthermore, the nozzle communication hole 40 and the individual communication hole 41 are arranged to be on further outer sides in part than the pressure chamber 19 in the first direction. Specifically, as illustrated in FIGS. 3A and 3B, a part of the nozzle communication hole 40 is arranged at a position superimposed in the bonding surface between the pressure chamber substrate 20 and the communication plate 16 with respect to the end portion of the pressure chamber 19 on one side (right side in FIG. 3A or 3B), and the remaining part of the nozzle communication hole 40 is arranged on an outer side with respect to the pressure chamber 19 (end portion on the one side) in the first direction. In addition, a part of the individual communication hole 41 is arranged at a position superimposed in the bonding surface between the pressure chamber substrate 20 and the communication plate 16 with respect to the end portion of the pressure chamber 19 on the other side (left side in FIG. 3A or 3B), and the remaining part of the nozzle communication hole 40 is arranged on an outer side with respect to the pressure chamber 19 (end portion on the one side) in the first direction. In other words, the nozzle communication hole 40 is arranged such that a part thereof protrudes to a further outer side than the three partition walls which constitute the end portion on the one side of the pressure chamber 19. Accordingly, a second step 44, where a bottom surface of the pressure chamber substrate 20 is exposed when viewed from the bonding surface side between the pressure chamber substrate 20 and the communication plate 16, is formed at a communication portion between the nozzle communication hole 40 and the pressure chamber 19. In addition, the individual communication hole 41 is arranged such that a part thereof protrudes to a further outer side than the three partition walls which constitute the end portion on the other side of the pressure chamber 19. Accordingly, the second step 44, where the bottom surface of the pressure chamber substrate 20 is exposed when viewed from the bonding surface side between the pressure chamber substrate 20 and the communication plate 16, is also formed at a communication portion between the individual communication hole 41 and the pressure chamber 19.

The nozzle plate 15 is a plate material that is manufactured by the silicon single crystal substrate or the like, where the plurality of nozzles 45 are disposed to be open in a row shape at a pitch corresponding to a dot formation density. In the present embodiment, the 360 nozzles 45 are disposed in arrays at a pitch corresponding to 360 dpi to constitute the nozzle column (a type of nozzle group). In addition, in the present embodiment, the two nozzle columns are formed on the nozzle plate 15.

In the recording head 3 that has this configuration, the ink from the ink cartridge 7 is introduced through the ink introduction path 28 such that the flow paths in the recording head 3 such as the common liquid chamber 39 and the pressure chamber 19 are filled with the ink. Then, the control signal from the control unit is supplied to the piezoelectric element 22 such that the piezoelectric element 22 is deflected. In this manner, the active portion 37 of the pressure chamber 19 is displaced and pressure change is generated in the ink in the pressure chamber 19. By using the pressure change, the ink in the pressure chamber 19 is ejected from the nozzle 45 via the nozzle communication hole 40.

Figure 4:
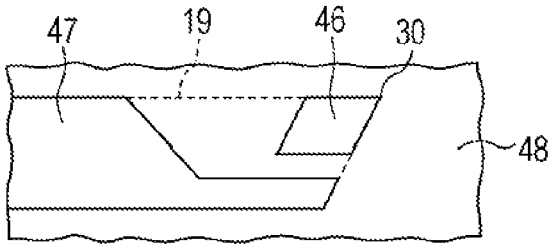
FIG. 4 is a plan view illustrating a main part of a mask pattern that forms a pressure chamber.
Figure 5A:
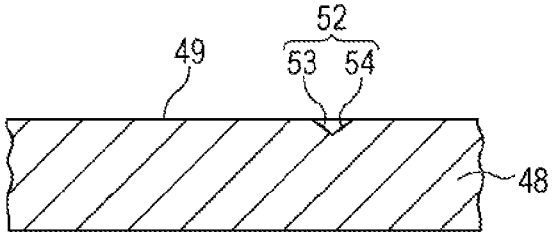
FIGS. 5A to 5F are cross-sectional state transition views illustrating a process for forming a first step of the pressure chamber.
Figure 5B:
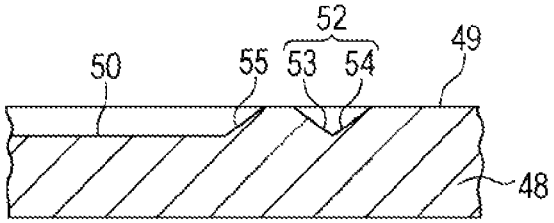
Figure 5C:
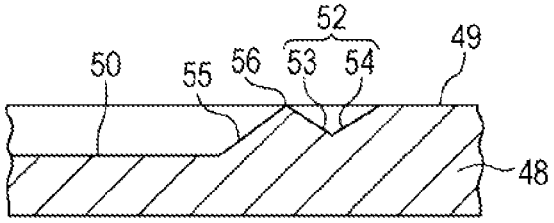

Next, a method for manufacturing the recording head 3 will be described in detail. In particular, a process for forming the pressure chamber substrate 20 will be described in detail. FIG. 4 is a plan view illustrating a main part of a mask pattern that forms the pressure chamber 19. In addition, FIGS. 5A to 5F are cross-sectional state transition views illustrating the process for forming the first step 32 of the pressure chamber 19. Furthermore, FIGS. 6A to 6C are cross-sectional views illustrating a process for manufacturing the recording head 3. In FIGS. 4 to 5F, only the end portion of the pressure chamber 19 on one side in the first direction is illustrated due to the symmetry with respect to the center of the pressure chamber 19, and description of the end portion on the other side is omitted. In addition, a hatching part in FIG. 4 is an open part where resist is removed.

The formation of the pressure chamber substrate 20 will be described. First, a silicon oxide film (hereinafter, simply referred to as an oxide film) is formed through a thermal oxidation treatment or the like on the surface of a silicon wafer 48 (silicon single crystal substrate) whose surface is the (110) plane. Any mask with respect to etching may be used, not limited to the silicon oxide film. Then, a resist pattern is disposed on the oxide film and the oxide film is removed by using an etching solution such as an aqueous solution such that the mask pattern with respect to the etching illustrated in FIG. 4 is formed. In the present embodiment, an auxiliary pattern 46 with a parallelogrammic shape, from which the oxide film is removed, is formed at a part of the pressure chamber 19 corresponding to the acute angle portion 30. In addition, a pressure chamber forming pattern 47, from which the oxide film is removed, is formed apart from the auxiliary pattern 46 at a part of the pressure chamber 19 not corresponding to the acute angle portion 30. In addition to these patterns, a break pattern (not illustrated) is formed along a cutting line so as to cut the silicon wafer 48 into the individual pressure chamber substrates 20.

When the mask pattern is formed by the oxide film, an etching solution that is formed of a potassium hydroxide (KOH) aqueous solution which is adjusted to, for example, a temperature of 78° C. and a concentration of 20 wt % is used such that a surface 49 ((110) plane) of the silicon wafer 48 is subjected to anisotropic etching. The surface 49 of the silicon wafer 48, after becoming the pressure chamber substrate 20, corresponds to the surface to which the communication plate 16 side is bonded. When the anisotropic etching is initiated, a V-shaped groove 52 formed of the (111) plane inclined with respect to the surface 49 appears at a part corresponding to the auxiliary pattern 46 as illustrated in FIG. 5A. Specifically, the V-shaped groove 52 is formed by a first inclined surface 53 formed of the (111) plane on the pressure chamber forming pattern 47 side and a second inclined surface 54 formed of the (111) plane on the side opposite thereto. When erosion by the etching solution proceeds, the part corresponding to the pressure chamber forming pattern 47 is gradually removed from the surface 49 as illustrated in FIG. 5B, and a parallel surface 50 formed of the (110) plane parallel to the surface 49 is formed in the middle in the plate thickness direction. In addition, a third inclined surface 55 formed of the (111) plane inclined with respect to the surface 49 is formed at an edge on an outer side (auxiliary pattern 46 side) of the parallel surface 50 in the first direction. The first inclined surface 53 and the second inclined surface 54 are eroded with an angle therebetween maintained on the auxiliary pattern 46 side. In this manner, the groove 52 is deepened. When the erosion by the etching solution further proceeds from this state, the parallel surface 50 is eroded in the plate thickness direction and the third inclined surface 55 at the edge thereof is eroded with the angle maintained as illustrated in FIG. 5C. At the same time, the erosion of the first inclined surface 53 and the second inclined surface 54 also proceeds. Then, a ridge portion 56 that is pointed toward the surface 49 appears at a boundary (boundary between a part that is cut on the pressure chamber forming pattern 47 side and a part that is count on the auxiliary pattern 46 side) between the third inclined surface 55 and the first inclined surface 53.

Figure 5D:
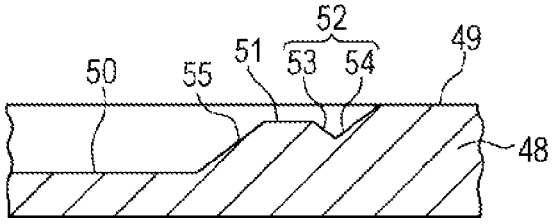
Figure 5E:
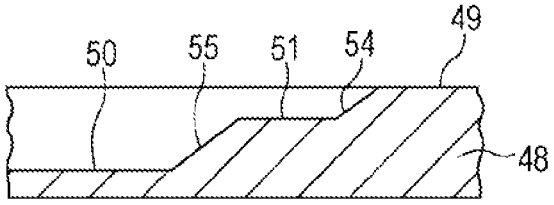
Figure 5F:
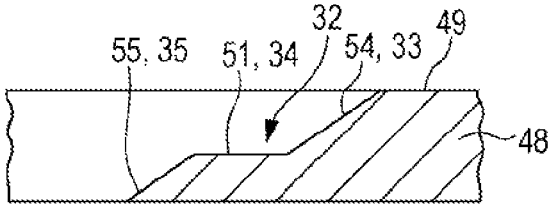
Figure 6A:
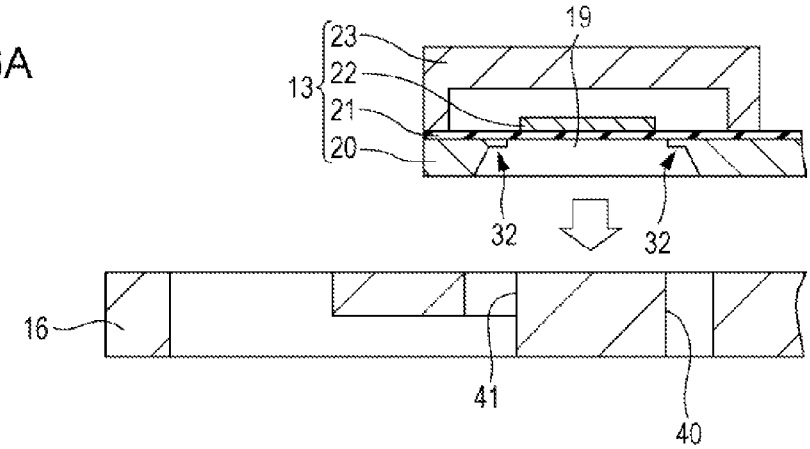
FIGS. 6A to 6C are cross-sectional views illustrating a process for manufacturing the recording head.
Figure 6B:
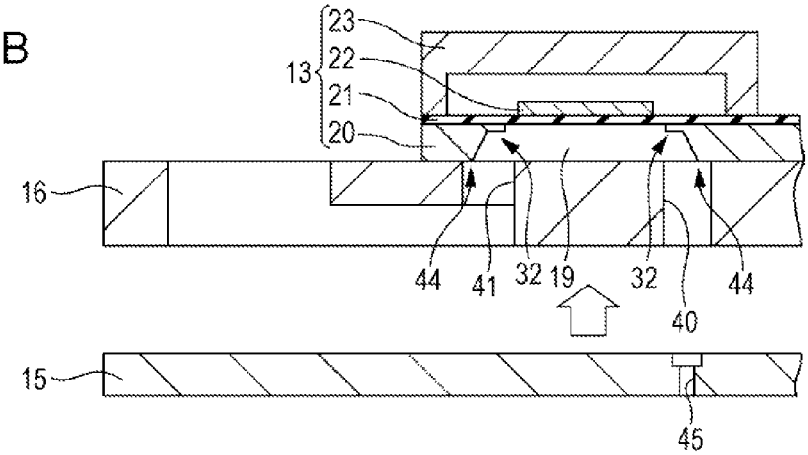
Figure 6C:
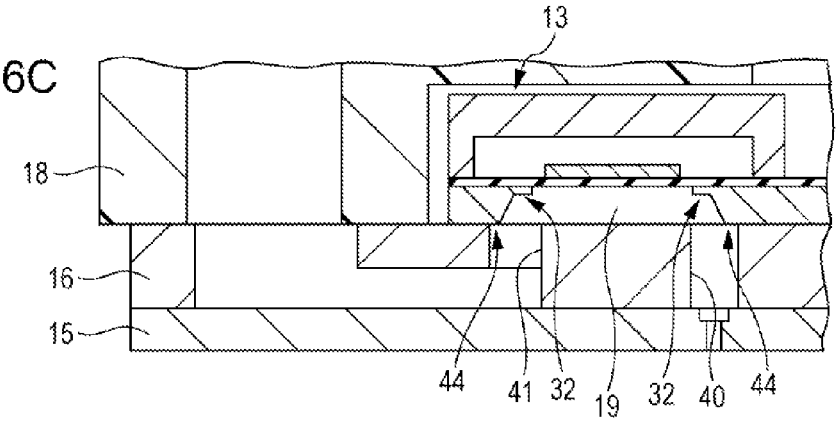

When the erosion by the etching solution further proceeds therefrom, the ridge portion 56 is cut as illustrated in FIG. 5D, and a flat surface 51 that is formed of the (110) plane which is parallel to the surface 49 is formed in the middle in the plate thickness direction between the third inclined surface 55 and the first inclined surface 53. The flat surface 51 appears later than the parallel surface 50, and thus is formed on a further surface 49 side than the parallel surface 50 where the erosion proceeds. In addition, the erosion of the flat surface 51 proceeds in the plate thickness direction by the etching solution. When the erosion of the flat surface 51 proceeds, the first inclined surface 53 disappears as illustrated in FIG. 5E. In other words, the flat surface 51 is formed between the second inclined surface 54 and the third inclined surface 55. Lastly, a part that corresponds to the pressure chamber 19 penetrates in the plate thickness direction when the erosion by the etching solution proceeds and the parallel surface 50 is completely removed. Then, the second inclined surface 54 (communication plate side (111) plane 33), the flat surface 51 (intermediate (110) plane 34), and the third inclined surface 55 (elastic film side (111) plane 35) are left in the end portion of the pressure chamber 19 in the first direction. The first step 32 is formed in this manner. When the pressure chamber substrate 20 is formed of silicon and the mask pattern that has the pressure chamber forming pattern 47 and the auxiliary pattern 46 is used as described above, the first step 32 can be produced in a simple manner through one session of the anisotropic etching. When the anisotropic etching is completed, the silicon wafer 48 is decoupled into the individual pressure chamber substrates 20 by using a method such as expanding break.

The other members such as the communication plate 16 and the nozzle plate 15 can be produced also through the etching of the silicon wafer with a predetermined mask pattern and the decoupling into individual substrates. In addition, as illustrated in FIG. 6A, the elastic film 21, the piezoelectric element 22, and the protective substrate 23 are stacked on the upper surface of the pressure chamber substrate 20 that is formed in the above-described manner, and the pressure generating unit 13 is produced in advance.

Next, the nozzle plate 15, the communication plate 16, and the pressure generating unit 13 are bonded by using the liquid adhesive. An instant adhesive, a UV adhesive, or the like is used as the adhesive. First, the adhesive is applied in a substantially uniform manner, by using an application method such as transfer, to a part of the upper surface (surface on an upper side in FIG. 2) of the communication plate 16 corresponding to the pressure generating unit 13. In this state, the pressure generating unit 13 (pressure chamber substrate 20) is pressed and adhered from the upper surface side of the communication plate 16 as illustrated in FIG. 6A. When the adhesive application amount is excessive due to variations of the adhesive application amount or the like in this case, the adhesive that leaks from the bonding surface between the communication plate 16 and the pressure chamber substrate 20 may move toward the upper side (pressure chamber substrate 20 side) along the acute angle portion 30 of the pressure chamber 19. However, according to the invention, the first step 32 is disposed in the pressure chamber 19 as described above and the second step 44 is formed in the communication portion between the pressure chamber 19 and the communication hole, and thus the movement of the leaking adhesive is inhibited by the steps 32 and 44. In this manner, it is possible to prevent the adhesive from reaching the active portion 37, which is formed on the upper side (elastic film 21 side) of the pressure chamber 19, and curing, and thus the inhibition of the displacement of the active portion 37 by a cured adhesive can be suppressed. As a result, variations of the ejection characteristics of the ink that is ejected from the nozzle 45 can be suppressed. In the present embodiment, the inclined surfaces 33 and 35 are disposed between the partition walls that partition the acute angle portion 30, and thus a capillary force is unlikely to be exerted at the part and the movement of the adhesive is further suppressed. In addition, since the first step 32 is disposed between the inclined surfaces 33 and 35, the movement of the adhesive to the elastic film 21 side ahead of the first step 32 is further suppressed.

Next, the adhesive is applied in a substantially uniform manner to the entire lower surface (surface on a lower side in FIG. 2) of the communication plate 16. In this state, the nozzle plate 15 is pressed and adhered from the lower surface side of the communication plate 16 as illustrated in FIG. 6B. When the adhesive application amount is excessive due to the variations of the adhesive application amount or the like in this case, the adhesive that leaks from the bonding surface between the nozzle plate 15 and the communication plate 16 may also move toward the upper side (pressure chamber substrate 20 side) along the acute angle portion of the nozzle communication hole 40. However, according to the invention, the second step 44 is formed in the communication portion between the pressure chamber 19 and the nozzle communication hole 40, and thus the penetration of the pressure chamber 19 by the adhesive is suppressed. As a result, the variations of the ejection characteristics of the ink that is ejected from the nozzle 45 can be further suppressed.

Lastly, the case 18 is bonded, by using the adhesive or the like, from the upper surface side (pressure chamber substrate 20 side) of the communication plate 16 in a state where the pressure generating unit 13 is accommodated in the accommodating hollow portion 27 as illustrated in FIG. 6C. The recording head 3 described above can be produced in this manner.

The invention is not limited to the embodiment described above, and various modifications are possible based on the scope of claims.

Figure 7:
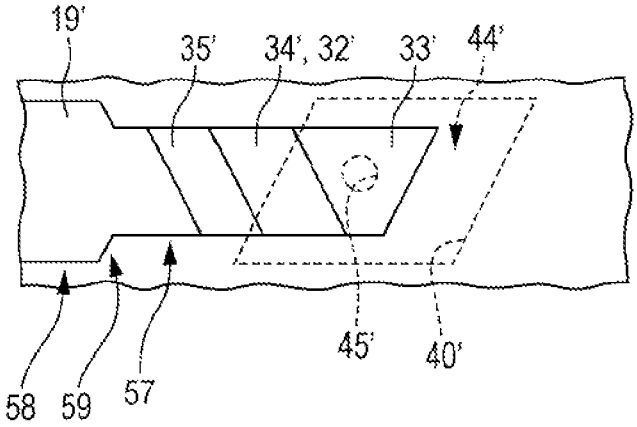
FIG. 7 is an enlarged bottom view of a main part of a pressure chamber substrate according to a second embodiment.

For example, the width (length in the nozzle column direction) of the pressure chamber 19 is constant in the embodiment described above, but the invention is not limited thereto. In a second embodiment illustrated in FIG. 7, a narrow portion 57 is formed in an end portion of a pressure chamber 19' that communicates with a nozzle communication hole 40', and the narrow portion 57 is narrower in width than the other part (central part (wide portion 58) in the first direction). Specifically, wall surfaces (wall surfaces that partition the pressure chamber 19' in the nozzle column direction) on both sides of the narrow portion 57 are arranged on further inner sides than wall surfaces on both sides of the wide portion 58. The wall surface is formed at an angle with respect to the first direction in a connection portion 59 between the narrow portion 57 and the wide portion 58. The nozzle communication hole 40' communicates with the narrow portion 57 such that a second step 44' is formed. More specifically, a communication plate side (111) plane 33', an intermediate (110) plane 34', and an elastic film side (111) plane 35' are formed in the narrow portion 57. In this case, the width of the nozzle communication hole 40' can be decreased and a pitch at which the nozzle communication hole 40' is formed can be decreased. As a result, the pitch of a nozzle 45' can be decreased and the resolution can be increased. In the present embodiment, a first step 32' is disposed in the narrow portion 57. In addition, a narrow portion that is narrower in width than the other part may be formed in an end portion of the pressure chamber communicating with the individual communication hole and a second step may be formed in the communication portion. Even in this case, a pitch at which the individual communication hole is formed can be decreased and the pitch of the nozzle can be decreased. The other configuration is the same as in the embodiment described above and thus description thereof will be omitted.

Figure 8:
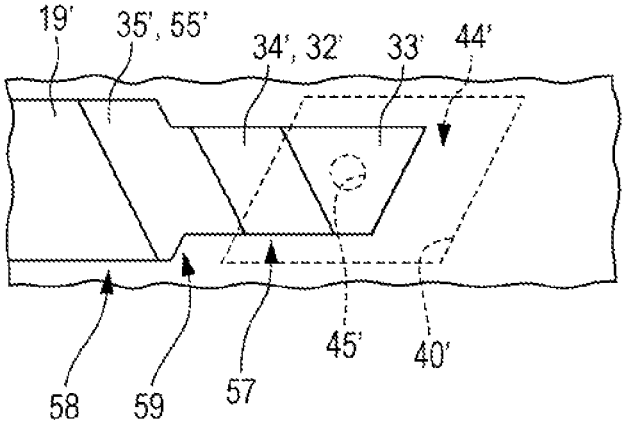
FIG. 8 is an enlarged bottom view of a main part of a pressure chamber substrate according to a modification example of the second embodiment.

In a modification example of the second embodiment illustrated in FIG. 8, the connection portion 59 of the pressure chamber 19' is formed to be positioned in the middle of the elastic film side (111) plane 35'. Specifically, the intermediate (110) plane 34' (first step 32') is formed in the narrow portion 57, and the elastic film side (111) plane 35' (third inclined surface 55') extends from the intermediate (110) plane 34', that is, the narrow portion 57 to the wide portion 58 of the pressure chamber 19'. Since the connection portion 59, where the width of the pressure chamber 19' changes is formed in the middle of the elastic film side (111) plane 35' (third inclined surface 55') in this manner, a path along the wall surface (corner portion) reaching the elastic film 21 from the intermediate (110) plane 34' is long and a path of the movement of the adhesive from the second step 44' to the elastic film 21 is long. As a result, the movement of the adhesive, leaking when the respective substrates are bonded, to the elastic film 21 side can be further suppressed. The connection portion 59 can also be disposed to be positioned in the middle of the intermediate (110) plane 34' and the communication plate side (111) plane 33'. The other configuration is the same as in the second embodiment described above and thus description thereof will be omitted.

Figure 9:
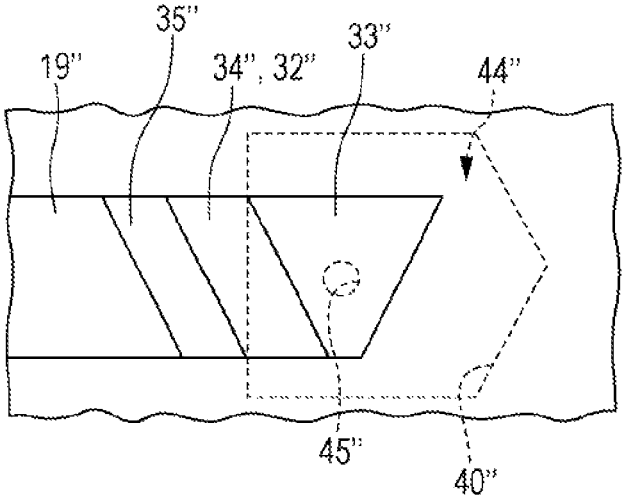
FIG. 9 is an enlarged bottom view of a main part of a pressure chamber substrate according to a third embodiment.

The nozzle communication hole 40 is formed into a parallelogrammic shape in a plan view in the embodiment described above, but the invention is not limited thereto. For example, in a third embodiment illustrated in FIG. 9, a nozzle communication hole 40" is formed into a pentagonal shape in a plan view. Even in the present embodiment, the nozzle communication hole 40" is formed to be wider in width than a pressure chamber 19" and a second step 44" is formed at a communication part between the nozzle communication hole 40" and the pressure chamber 19". In other words, a part of the nozzle communication hole 40" is arranged to protrude to a further outer side than three partition walls constituting an end portion on one side of the pressure chamber 19". When the nozzle communication hole 40" has a pentagonal shape in this manner, formation of an acute angle portion at an interior angle formed by the partition wall partitioning the nozzle communication hole 40" can be suppressed. As a result, the movement of the adhesive along the interior angle portion of the communication hole can be suppressed even when the adhesive leaks from a bonding surface between the communication plate 16" and the pressure chamber substrate 20". In addition, the interior angle portion expands more compared to the nozzle communication hole 40" that has the parallelogrammic shape, and thus the adhesive leaking from the bonding surface is distributed to the respective interior angle portions. Accordingly, the amount of the adhesive moving in the one interior angle portion can be reduced, and the movement of the adhesive to an active portion 37" of the pressure chamber 19" can be suppressed. Likewise, the individual communication hole may be formed into a pentagonal shape in a plan view. In addition, the shapes of the nozzle communication hole 40" and the individual communication hole are not limited to the pentagonal shape but may be a polygonal shape with a larger number of interior angles. The other configuration is the same as in the embodiment described above and thus description thereof will be omitted.

Figure 10:
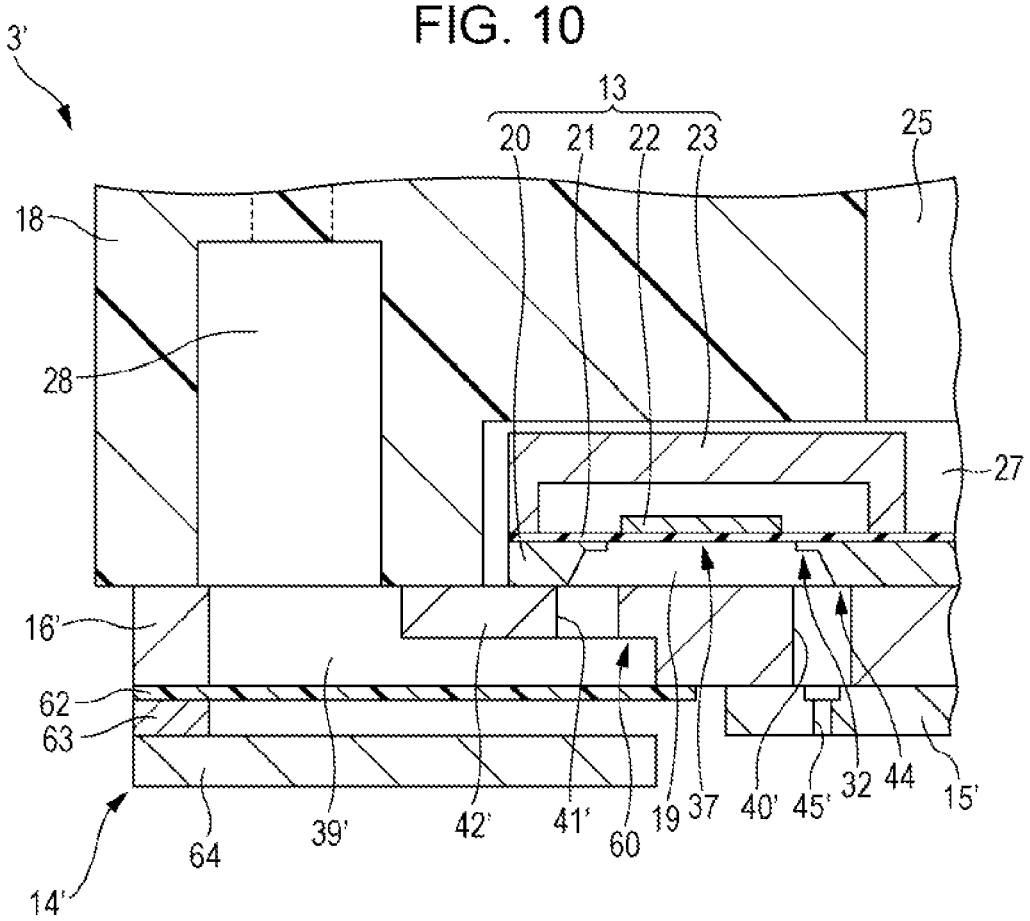
FIG. 10 is a cross-sectional view of a recording head according to a fourth embodiment.
Figure 11:
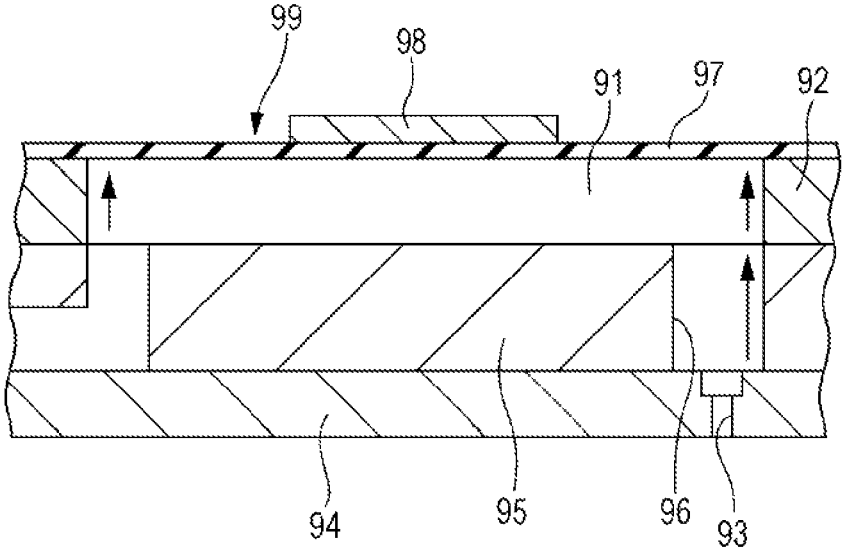
FIG. 11 is a cross-sectional view of a recording head according to the related art.

Furthermore, the first step 32 is disposed in the pressure chamber 19 and the second step 44 is formed in the communication portion between the pressure chamber 19 and the nozzle communication holes 40 and 41 in the first embodiment described above, but the invention is not limited thereto. For example, in a recording head 3' according to a fourth embodiment illustrated in FIG. 10, a third step 60, in addition to the first step 32 and the second step 44, is disposed in a communication portion between an individual communication hole 41' and a common liquid chamber 39'. Specifically, the third step 60 is formed such that the individual communication hole 41' is open at a position shifted from an end portion of the nozzle communication hole 40' side (nozzle 45' side) to an inner side (side opposite to the nozzle communication hole 40' side) of the common liquid chamber 39' in a thin portion 42' of the common liquid chamber 39' and the thin portion 42' is left in an area on a further nozzle communication hole 40' side than the individual communication hole 41' in the common liquid chamber 39'. The third step 60 described above is produced by etching a communication plate 16' from a nozzle plate 15' side (compliance sheet 62 side).

In addition, in a flow path unit 14' of the present embodiment, the nozzle plate 15' is reduced in size as much as possible, and an opening portion of the common liquid chamber 39' that is open to a lower surface of the communication plate 16' is sealed by the compliance sheet 62. The compliance sheet 62 has flexibility, and functions as a compliance portion which absorbs the pressure change of the ink in the common liquid chamber 39'. A sheet supporting plate 63 is bonded from a lower surface side to an end portion area on the side opposite to the nozzle plate 15' of the compliance sheet 62 which is shifted from the common liquid chamber 39'. Furthermore, a fixed plate 64, which protects the vicinity of the nozzle plate 15', is connected to the lower surface of the sheet supporting plate 63. The fixed plate 64 of the present embodiment is arranged in an area facing the compliance portion in a state where the fixed plate 64 is apart from the compliance sheet 62 in an extent to which the displacement of the compliance portion is not interfered with. The other configuration is the same as in the first embodiment described above and thus description thereof will be omitted.

The third step 60 is disposed in the communication portion between the individual communication hole 41' and the common liquid chamber 39' in this manner. Accordingly, when the compliance sheet 62 and the communication plate 16' are bonded via the liquid adhesive, the third step 60 can suppress (inhibit) the movement of the adhesive toward the pressure chamber 19 side along the wall surface of the individual communication hole 41'. The configuration in which the third step 60 is provided can also be applied to the configuration in which the common liquid chamber 39 is sealed by the nozzle plate 15 as in the first embodiment described above. In this case, the third step 60 can suppress (inhibit) the movement of the adhesive, which adheres the nozzle plate 15 with the communication plate 16, toward the pressure chamber 19 side along the wall surface of the individual communication hole 41'.

The communication plate 16 and the pressure chamber substrate 20 are produced by etching a substrate formed of silicon (silicon wafer) in the respective embodiments described above, but the invention is not limited thereto. For example, the communication plate 16 and the pressure chamber substrate 20 can also be produced by using a metal such as SUS, a synthetic resin, or the like. In addition, a method for forming the flow path shapes of the pressure chamber 19, the first step 32, the individual communication hole 41, the nozzle communication hole 40, and the like is not limited to the etching. For example, the formation can be performed by press molding, thermal spray, electro-discharge machining, or the like.

In addition, the one step (first step 32) is formed in each of both of the end portions of the pressure chamber 19 in the first direction in the respective embodiments described above, but the invention is not limited thereto. At least two steps may be disposed in at least one of the end portions of the pressure chamber in the first direction. The plurality of such steps are formed to be shifted with respect to a planar direction (plane direction that is parallel to the bonding surface between the pressure chamber substrate and the communication plate). In addition, the second step 44 is formed in the communication portion between the pressure chamber 19 and the nozzle communication holes 40 and 41 in the respective embodiments described above, but the invention is not limited thereto. For example, an additional step can be formed in the communication plate below the second step and a plurality of steps can be formed in the communication portion between the pressure chamber 19 and the nozzle communication holes 40 and 41. At least two steps may be formed, shifted in the planar direction, in the inner wall surface of the flow path reaching the nozzle communication holes 40 and 41 from the pressure chamber 19.

Furthermore, the nozzle communication hole 40 and the individual communication hole 41 are respectively arranged to protrude to further outer sides than the three partition walls partitioning the pressure chamber in the end portions having the acute angle portion 30 and the obtuse angle portion 31 of the pressure chamber 19 in the respective embodiments described above, but the invention is not limited thereto. For example, the second step may be formed by forming the nozzle communication hole and the individual communication hole to have a width substantially equal to the width of the pressure chamber and arranging a part thereof to protrude to an outer side in the first direction. The second step may be formed in the communication portion between the pressure chamber and the communication hole by arranging a part of the communication hole of at least one of the nozzle communication hole and the individual communication hole at a position superimposed on the acute angle portion in the bonding surface and arranging the remaining part of the communication hole on an outer side in the first direction with respect to the acute angle portion. In addition, the second step may be formed in the communication portion between the pressure chamber and the communication hole by arranging the nozzle communication hole or the individual communication hole to a further inner side than the pressure chamber. In other words, the second step may be formed by arranging the partition wall partitioning the pressure chamber to protrude to a further outer side than the nozzle communication hole or the individual communication hole. The second step may be formed to expand the flow path across the pressure chamber from the communication hole and may be formed by narrowing the flow path. Furthermore, the second inclined surface, the third inclined surface, and the flat surface are formed of the (111) plane and the (110) plane in the embodiment described above, but the present invention is not limited thereto. For example, these surfaces may be formed of a crystal surface other than the exemplary crystal surface and a surface other than the crystal surface. The first step may be formed in the pressure chamber substrate.

The ink jet type recording head 3 that is a type of liquid ejecting head has been used as an example in the above description, but the invention can also be applied to the ejection of liquids other than ink. For example, the invention can also be applied to a color material ejecting head used in manufacturing a color filter such as a liquid crystal display, a liquid material ejecting head used in forming an electrode such as an organic electro luminescence (EL) display and a field emission display (FED), a bio-organic material ejecting head used in manufacturing a biochip (biological and chemical element), and the like.

The entire disclosure of Japanese Patent Application No.: 2013-121579, filed Jun. 10, 2013, 2013-151380, filed Jul. 22, 2013 and 2014-014085, filed Jan. 29, 2014 are expressly incorporated by reference herein.

What is claimed is:

1. A liquid ejecting head comprising:

a pressure chamber substrate where a pressure chamber that communicates with a nozzle which ejects a liquid is formed; and a communication plate that is bonded to one surface of the pressure chamber substrate and is penetrated in a plate thickness direction by a communication hole which communicates with an end portion of the pressure chamber in a first direction, wherein acute angle portions are formed, by partition walls intersecting with each other at an acute angle, in both end portions of the pressure chamber in a first direction, wherein a first step is disposed in a middle of each of the acute angle portions in the plate thickness direction, and wherein a second step is formed in a communication portion between the pressure chamber and the communication hole by arranging a part of the communication hole at a position superimposed on the acute angle portion in a bonding surface and arranging a remaining part of the communication hole on an outer side in the first direction with respect to the acute angle portion, wherein the first step includes a plane and the second step includes a plane and wherein the plane of the first step and the plane of the second step are parallel to the bonding surface between the communication plate and the pressure chamber substrate.

2. The liquid ejecting head according to claim 1, wherein the communication plate includes a first communication hole that communicates with an end portion on one side of the pressure chamber in the first direction, and a second communication hole that communicates with an end portion on the other side of the pressure chamber in the first direction, and wherein the second step is formed in each of the communication portions between both of the acute angle portions of the pressure chamber and the first communication hole and the second communication hole.

3. A liquid ejecting apparatus comprising the liquid ejecting head according to claim 2.

4. The liquid ejecting head according to claim 1, wherein the first step is disposed in an inclined surface that is formed in a state of being inclined with respect to the bonding surface between the partition walls partitioning the acute angle portion and extends from a vertex of the acute angle portion on the bonding surface to a surface on a side opposite to the bonding surface on the pressure chamber substrate.

5. A liquid ejecting apparatus comprising the liquid ejecting head according to claim 4.

6. A liquid ejecting apparatus comprising the liquid ejecting head according to claim 1.

7. A liquid ejecting head comprising:

a pressure chamber substrate where a pressure chamber that communicates with a nozzle which ejects a liquid is formed; and a communication plate that is bonded to one surface of the pressure chamber substrate and is penetrated in a plate thickness direction by a communication hole which communicates with an end portion of the pressure chamber in a first direction, wherein at least two steps are formed, shifted in a plane direction parallel to a bonding surface between the pressure chamber substrate and the communication plate, in an inner wall surface of a flow path reaching the communication hole from the pressure chamber, wherein the at least two steps include planes that are parallel to the bonding surface between the communication plate and the pressure chamber substrate.

8. A liquid ejecting apparatus comprising the liquid ejecting head according to claim 7.

* * * * *